US009247825B2

(12) United States Patent
Polevoy et al.

(10) Patent No.: US 9,247,825 B2
(45) Date of Patent: Feb. 2, 2016

(54) WRAP AROUND BED FRAME

(71) Applicants: Richard S. Polevoy, Teaneck, NJ (US); Paul E. Carlson, Skaneateles, NY (US); Michael W Konieczny, Skaneateles, NY (US); Robert L. Naas, Skaneateles, NY (US)

(72) Inventors: Richard S. Polevoy, Teaneck, NJ (US); Paul E. Carlson, Skaneateles, NY (US); Michael W Konieczny, Skaneateles, NY (US); Robert L. Naas, Skaneateles, NY (US)

(73) Assignee: Finger Lakes Intellectual Property LLC, Teaneck, NJ (US)

( * ) Notice: Subject to any disclaimer, the term of this patent is extended or adjusted under 35 U.S.C. 154(b) by 0 days.

(21) Appl. No.: 14/351,632

(22) PCT Filed: Oct. 15, 2012

(86) PCT No.: PCT/US2012/060183

§ 371 (c)(1),
(2) Date: Apr. 14, 2014

(87) PCT Pub. No.: WO2013/056207

PCT Pub. Date: Apr. 18, 2013

(65) Prior Publication Data

US 2014/0338125 A1 Nov. 20, 2014

Related U.S. Application Data

(60) Provisional application No. 61/547,366, filed on Oct. 14, 2011.

(51) Int. Cl.
*A47C 19/00* (2006.01)
*A47C 19/02* (2006.01)

(52) U.S. Cl.
CPC ..... *A47C 19/005* (2013.01); *A47C 19/02* (2013.01); *A47C 19/021* (2013.01); *A47C 19/00* (2013.01)

(58) Field of Classification Search
CPC ..... A47C 19/00; A47C 19/005; A47C 19/02; A47C 19/021
USPC ..... 5/200.1, 201, 285, 286, 663, 424, 400; 52/717.05; 248/345.1; 362/130
See application file for complete search history.

(56) References Cited

U.S. PATENT DOCUMENTS

| | | | | |
|---|---|---|---|---|
| 2,636,189 | A * | 4/1953 | Feldman | A47D 13/06 16/DIG. 2 |
| 3,683,429 | A | 8/1972 | Mis | |
| 3,760,437 | A | 9/1973 | Hooker | |
| 6,865,758 | B2 * | 3/2005 | Harrow | 5/288 |
| 6,925,666 | B2 * | 8/2005 | Harrow | 5/201 |
| 7,073,218 | B2 * | 7/2006 | Polevoy et al. | 5/201 |
| 7,100,228 | B2 * | 9/2006 | Polevoy et al. | 5/663 |
| 7,219,378 | B2 * | 5/2007 | Polevoy et al. | 5/200.1 |
| 7,363,664 | B2 * | 4/2008 | Polevoy et al. | 5/200.1 |
| 7,363,665 | B2 | 4/2008 | Polevoy et al. | |
| 7,363,666 | B2 * | 4/2008 | Polevoy et al. | 5/311 |

(Continued)

*Primary Examiner* — David E Sosnowski
(74) *Attorney, Agent, or Firm* — Klauber & Jackson LLC

(57) ABSTRACT

A wrap around bed frame for use in supporting a box spring and mattress. The bed frame has the normal side rails and cross members and also has a foot member that is affixed to the foot ends of the side rails such that the foot member provides support for the foot end of the bedding and prevents sagging and damage from weight being exerted at the foot end of the bedding. The entire bed frame can be assembled with fittings that do not require tools for assembly and thus, the bed frame can be assembled easily by the user by simply sliding or snapping the components together. Protective shields cover the bed frame so as to prevent tearing of the linen, bed spreads or other bed coverings used with the bed frame.

5 Claims, 13 Drawing Sheets

(56) References Cited

U.S. PATENT DOCUMENTS

| | | | | |
|---|---|---|---|---|
| 7,644,456 | B2 * | 1/2010 | Polevoy et al. | 5/201 |
| 7,665,163 | B2 * | 2/2010 | Polevoy et al. | 5/200.1 |
| 7,865,981 | B2 * | 1/2011 | Harrow | 5/400 |
| 7,874,027 | B2 | 1/2011 | Polevoy et al. | |
| 7,954,184 | B2 | 6/2011 | Polevoy et al. | |
| 8,006,328 | B2 * | 8/2011 | Polevoy et al. | 5/200.1 |
| 8,220,086 | B2 * | 7/2012 | Geiger | 5/201 |
| 8,234,734 | B2 * | 8/2012 | Perry | A47D 9/00 5/424 |
| 8,832,876 | B1 * | 9/2014 | Oh | 5/116 |
| 8,832,881 | B2 * | 9/2014 | Polevoy et al. | 5/663 |
| 8,863,328 | B2 * | 10/2014 | Dwyer et al. | 5/493 |
| 2002/0069462 | A1 * | 6/2002 | Gaboury | A47C 19/005 5/201 |
| 2004/0194217 | A1 * | 10/2004 | Polevoy et al. | 5/663 |
| 2005/0177949 | A1 * | 8/2005 | Polevoy et al. | 5/663 |
| 2005/0278848 | A1 * | 12/2005 | Polevoy et al. | 5/201 |
| 2005/0278849 | A1 * | 12/2005 | Polevoy et al. | 5/310 |
| 2005/0278858 | A1 * | 12/2005 | Polevoy et al. | 5/663 |
| 2006/0101772 | A1 * | 5/2006 | Suzuki | H04N 5/2251 52/646 |
| 2006/0191071 | A1 * | 8/2006 | Polevoy et al. | 5/201 |
| 2006/0213008 | A1 * | 9/2006 | Polevoy et al. | 5/310 |
| 2007/0044235 | A1 * | 3/2007 | Navarro | A47C 19/005 5/201 |
| 2007/0157381 | A1 * | 7/2007 | Polevoy et al. | 5/201 |
| 2008/0010744 | A1 * | 1/2008 | Polevoy et al. | 5/200.1 |
| 2008/0282636 | A1 * | 11/2008 | Roth | B64C 1/066 52/506.01 |
| 2009/0300840 | A1 * | 12/2009 | Polevoy et al. | 5/200.1 |
| 2010/0138993 | A1 * | 6/2010 | Polevoy et al. | 5/286 |
| 2010/0242171 | A1 * | 9/2010 | Polevoy et al. | 5/282.1 |
| 2011/0219540 | A1 * | 9/2011 | Polevoy et al. | 5/200.1 |

* cited by examiner

WRAP AROUND BED FRAME

CROSS REFERENCE TO RELATED APPLICATIONS

The present application is the National Stage of International Application No. PCT/US2012/60183, filed Oct. 15, 2012, which claims the benefit of priority to U.S. Provisional Application No. 61/547,366, filed Oct. 14, 2011, the disclosures of both of which applications are herein incorporated by reference in their entireties. Applicants claim the benefits of 35 U.S.C. 120 as to the PCT application and the United States application.

FIELD OF THE INVENTION

The present invention relates to a bed frame for supporting a mattress or mattress set and, more particularly, to a wrap around bed frame that includes a foot member to provide an all around support to a mattress and bedding.

BACKGROUND OF THE INVENTION

With a conventional bed frame, there normally are two side rails that are placed in a parallel orientation with respect to each other and one or more cross members that span between the side rails to provide support to the box spring and mattress. The sides of the box spring are supported by a horizontal flange of the side rails and the internal area of the box spring and mattress are supported by the cross members.

With many bed frames, the side rails and cross members are made of a metal, generally steel, and are comprised of steel angle irons. As a recent innovation, the side rails can also be comprised of angle irons joined together to form a T-shaped member or can be constructed and used as single, unitary steel components.

With a typical steel bed frame, the foot ends of the side rails extend beyond any supporting legs such that the foot ends of the side rails extend in cantilever manner outwardly from the foot end of the bed and there is no further component, such as a foot supporting member that provides support for the foot ends of the side rails.

There is currently a trend of not having a foot board at the foot end of the bed. The absence of a footboard not only reduces support at the foot end of the bed but eliminates the pleasing and decorative component that would normally cover and enclose the foot end bedding and give the overall foot end of the completed bed a pleasing appearance.

As such, the foot end of the box spring and mattress are basically unsupported and a weight placed at that end, such as by a person sitting on the very end of a mattress, can create bending and cause damage to the bed frame. This is particularly true of a king size bed frame where there may be two foundations in a side by side relationship and overlaid by a single mattress and, in such instance, there is a decided lack of support at the center of the bed where the two foundations come together.

A system for providing support to the foot end of a box spring and mattress has been shown and described in U.S. Pat. No. 7,363,665 entitled "Bed Frame With Extended Bumper Assembly", however, that reference discloses curved ends that joined a side rail and a straight member of a bumper assembly. The manufacture of curved ends, however, is fairly difficult in order to meet the tolerance requirements of joining a side rail and a bumper assembly.

Another difficulty with present bed frames is that there is a certain amount of labor used in securing the frame members together, that is, the metal components are affixed together by hand and often require hand tools to complete the assembly of a bed frame. As such, since the initial set up of a bed frame is normally carried out by a delivery person who may have multiple deliveries on the same day, the amount of time used to complete the set up of the bed frame is important and, obviously, there an advantage in being able to assemble the bed frame quickly and accurately in as little time as possible.

A further difficulty with current bed frames is that the metal structural components have sharp edges and joints and the presence of those sharp edges can cause tearing of the linen, bed spreads or other bed coverings used with the bed.

Accordingly, it would be advantageous to provide metal bed frame where the foot ends of the side rails are connected to a foot member to form an aesthetically pleasing design that visually provides a smooth continuation of the side rails that transition to the foot member as well as provide support to the foot end of a box spring and mattress.

It would be further advantageous to have a bed frame that was easily assembled without the need for tools or specialized skill and which was fully protected by some shields to cover any sharp edges of corners to prevent tearing or damage to the bed coverings.

SUMMARY OF THE INVENTION

In accordance with the present invention, there is a bed frame assembly that is used to support a box spring and mattress and which has side rails having a horizontal surface to support the sides of the box spring. There is at least one, and normally multiple, cross members to aid in the support of the box spring and mattress and which span the distance between the side rails.

At the foot ends of the side rail, there is a foot member that is connected by an affixation system so that the overall bed frame is a wrap around design that includes the foot member to support the foot end of the box spring and mattress. The affixation system includes a corner component that completes a smooth transition with linear surfaces (non-curved) between the side rail and the foot member to create a smooth appearance of the overall assembled bed.

In all, the foot member is affixed to the foot ends of the side rails by a simple affixation system that eliminates the need for tools to carry out that connection and includes the use of a separate component to carry out the transition. In addition, the cross members can also be affixed to the side rails in the assembly of a bed frame without the need for tools. As such, the entire bed frame, including the foot member and legs, are readily assembled without tools since all of the components of the bed frame either drop in, snap in or slide into the desired positions in the assembly of the bed frame.

As a further feature, all of the sharp edges and corners of the present bed frame are covered by plastic shields so that the tearing and damage to the bed coverings are prevented.

These and other features and advantages of the present invention will become more readily apparent during the following detailed description taken in conjunction with the drawings herein.

DETAILED DESCRIPTION OF THE INVENTION

Figure 1:
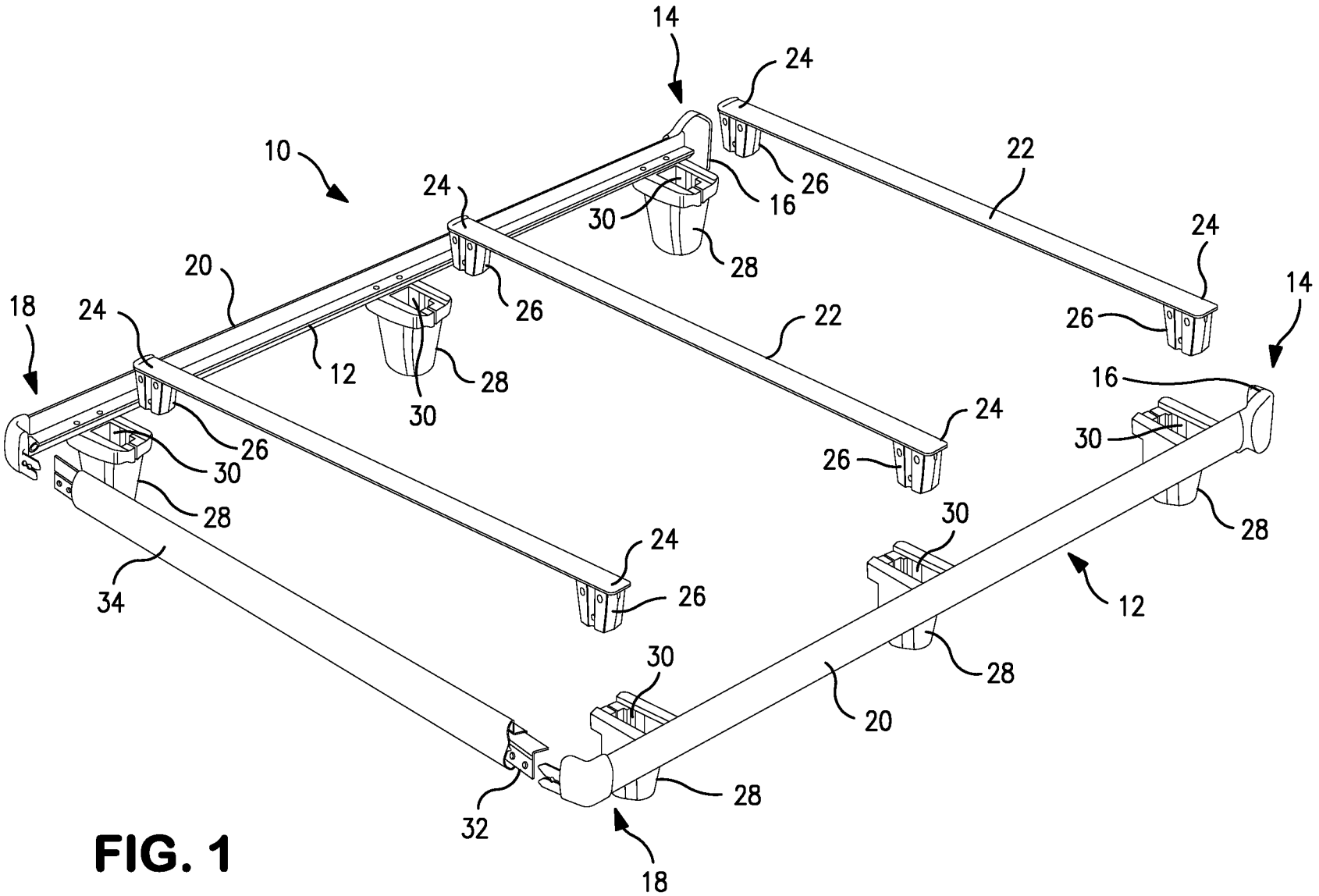
FIG. 1 is an exploded view illustrating an exemplary bed frame of the present invention.

Turning first to FIG. 1, there is shown an exploded view of a bed frame 10 constructed in accordance with the present invention. As can be seen in FIG. 1, the bed frame 10 is comprised of two side rails 12 that are oriented parallel to each other and support the side edges of a box spring and mattress. In the illustrated embodiment of FIG. 1, the side rails 12 are made up of L-shaped angle irons affixed together to produce a T-shaped structural member, however, the side rails 12 can also be other configurations, such as L-shaped angle irons or T-shaped members as shown and described in U.S. Pat. No. 7,954,184 of Polevoy et al and the disclosure of the '184 patent is hereby incorporated herein in its entirety by reference.

As will be described herein, the side rails 12, in the construction of the bed frame 10, have head ends 14 which are defined, and will be herein referred to, as the location where the head of the user is positioned and which normally will include head end brackets 16 for being affixed to a head board (not shown). The opposite ends of the side rails 12 are defined as the foot ends 18 where the feet of the user are designed to be located when the user is lying supine on the bed.

The side rails 12 can have protective shields 20 affixed thereto to create an esthetically pleasing appearance as well as provide protection against potential damage by ripping or tearing of the bed coverings by encountering an end or corner of an angle iron that forms the side rails 12. The shields can be constructed and assembled to the side rails 12 in accordance with that shown and described in U.S. Pat. No. 7,874,027 and the disclosure of the '027 patent is hereby incorporated herein in its entirety by reference.

There can also be seen, cross members 22 that have their ends 24 affixed to the side rails 12 and span the distance therebetween. At the ends 24 of each of the cross members 22, there is a wedge 26 formed and which interfits into a receiver 28 having a cavity 30 formed therein. The use of a wedge and receiver is shown and described in U.S. Published Application 2010/0242171 of Polevoy et al and the disclosure of the '171 publication is hereby incorporated herein in its entirety by reference.

A foot member 32 is present that is affixed to the foot ends 18 of the side rails 12 by means of an affixation system. The foot member 32 may be comprised of an L-shaped angle iron, a T-shaped angle iron, a combination of two L-shaped angle irons affixed together, an aluminum extruded member, a Fiberglas member or other configuration. In the exemplary embodiment of FIG. 1, the foot member 32 is a T-shape having a vertical flange 33 and a horizontal flange 37 that extends outwardly from the vertical flange 33 at about the middle of the vertical flange 33.

A protective shield 34 covers the foot member 32 that may be of the type shown and described in the aforementioned '027 patent of Polevoy et al.

Figure 1A:
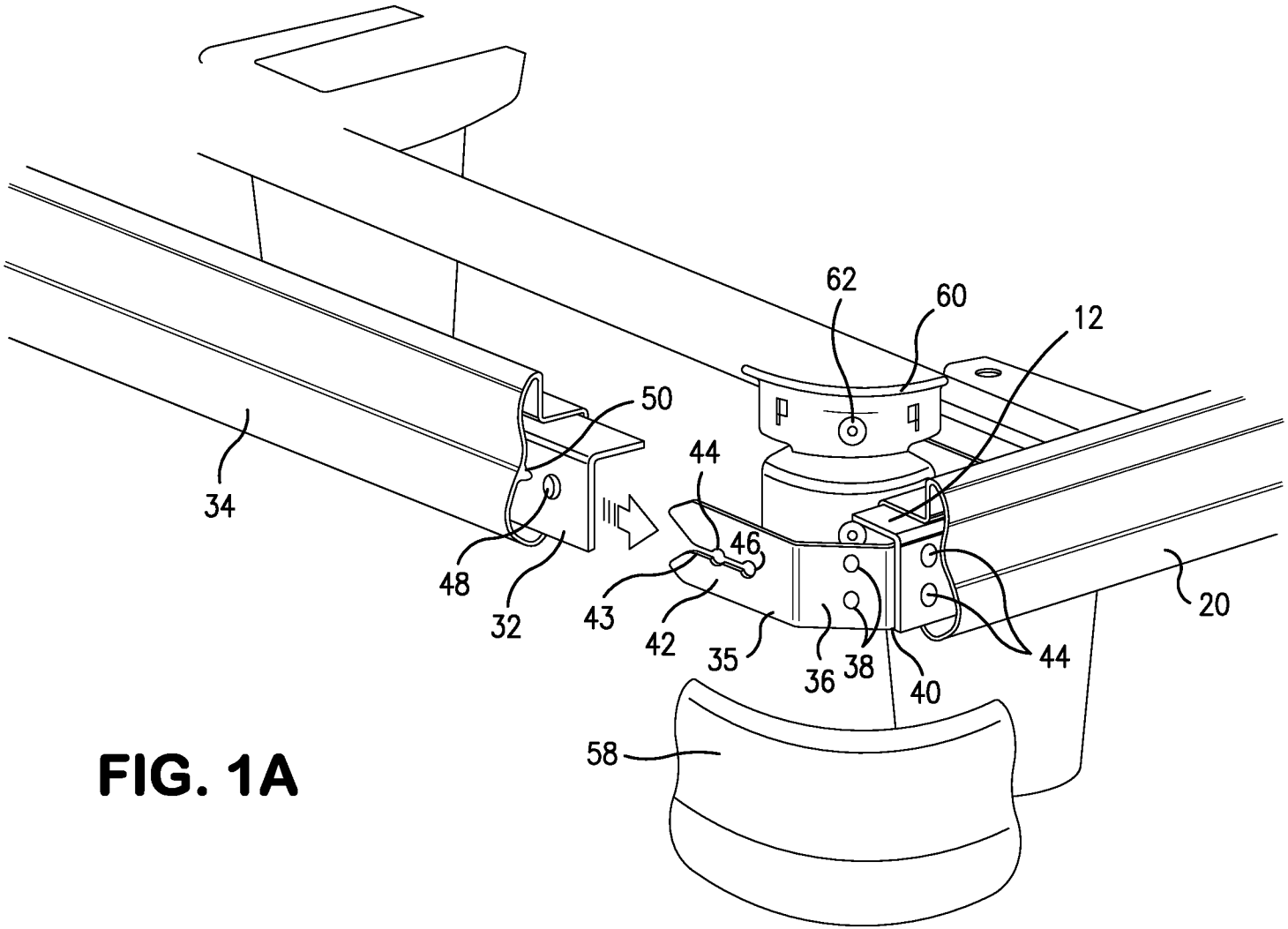
FIG. 1A is an enlarged, exploded view illustrating features of the FIG. 1 embodiment.

Turning then to FIG. 1A, taken along with FIG. 1, there is shown, an enlarged exploded view of the FIG. 1 embodiment and illustrating the affixation system that connects the foot member 32 to side rail 12 in a sliding, snap fit manner.

As such, there is a bracket 35 that provides a junction between the foot member 32 and the side rail 12. The bracket 35 is comprised of three sections; a middle section 36 having one or more holes 38, a side rail section 40 that is angled with respect to the middle section 36 and a foot member section 42 that is also angled with respect to the middle section 36. In an exemplary embodiment, the side rail section 40 and foot member section 42 both extending outwardly from the middle section 36 at about a 45 degree angle, however other angles could be utilized, with the summation of the angles adding up to 90 degrees.

In the embodiment of FIGS. 1 and 1A, the side rail section 40 of bracket 34 is affixed to the side rail 12 by means of rivets 44. The foot member section 42 has a slot 43 formed therein with enlarged openings 44, 46. As such, to make the connection between the foot member 32 and the side rail 12, the foot member section 42 is slid along the foot member 32 where the slot 43 engages standoff rivets 48, 50 provided in the vertical flange 33 of the foot member 32 below the horizontal flange 37 and, as the foot member section 42 reaches its ultimate position, the standoff rivet 48 snaps into the enlarged opening 46 and the standoff rivet 50 snaps into the enlarged opening 44 to hold the side rail 12 firmly to the foot member 32 in a manner that the foot member 32 provides support to the box spring and mattress later supported by the bed frame 10.

There is a curved protective shield 58 that covers the external surface of the bracket 35 so as to protect against the tearing or ripping of the bed coverings that may encounter a sharp edge of the bracket 35 as well as provide a good appearance of the overall wrap around bed frame 10. As can be seen in FIG. 1, the curved protective shield 58 may be pre-attached to the side rail 12 such that it simply slips over and overlaps the protective shield 34 that covers the foot member 32 to form a relatively seamless junction.

There can also be a internal curved protective shield 60 that covers and protects the internal surface of the bracket 35 and both of the shields 58, 60 may be affixed to the bracket 35 by means of a snap fit or may make use of the holes 38 so that the curved protective shield 58 can be affixed by screws that enter into and interfit with a boss 62 formed on the internal curved protective shield 60. A further feature is that the bracket 35 is symmetrical so that the same formed bracket can be used with each of the side rails 12 in assembling the bed frame 10.

As can now be seen, the assembly of the bed frame 10 of the FIG. 1, 1A embodiment is readily accomplished since all of the components drop in or snap in without the need for special tools or the like. The foot member 32 is initially installed by the slide in action and thereafter, once the foot member 32 has been installed, the cross members 22 are simply dropped in such that the wedges 26 fit into the receivers 28 to complete the installation of the cross members 22 and finalize the assembly of the bed frame 10.

Figure 2:
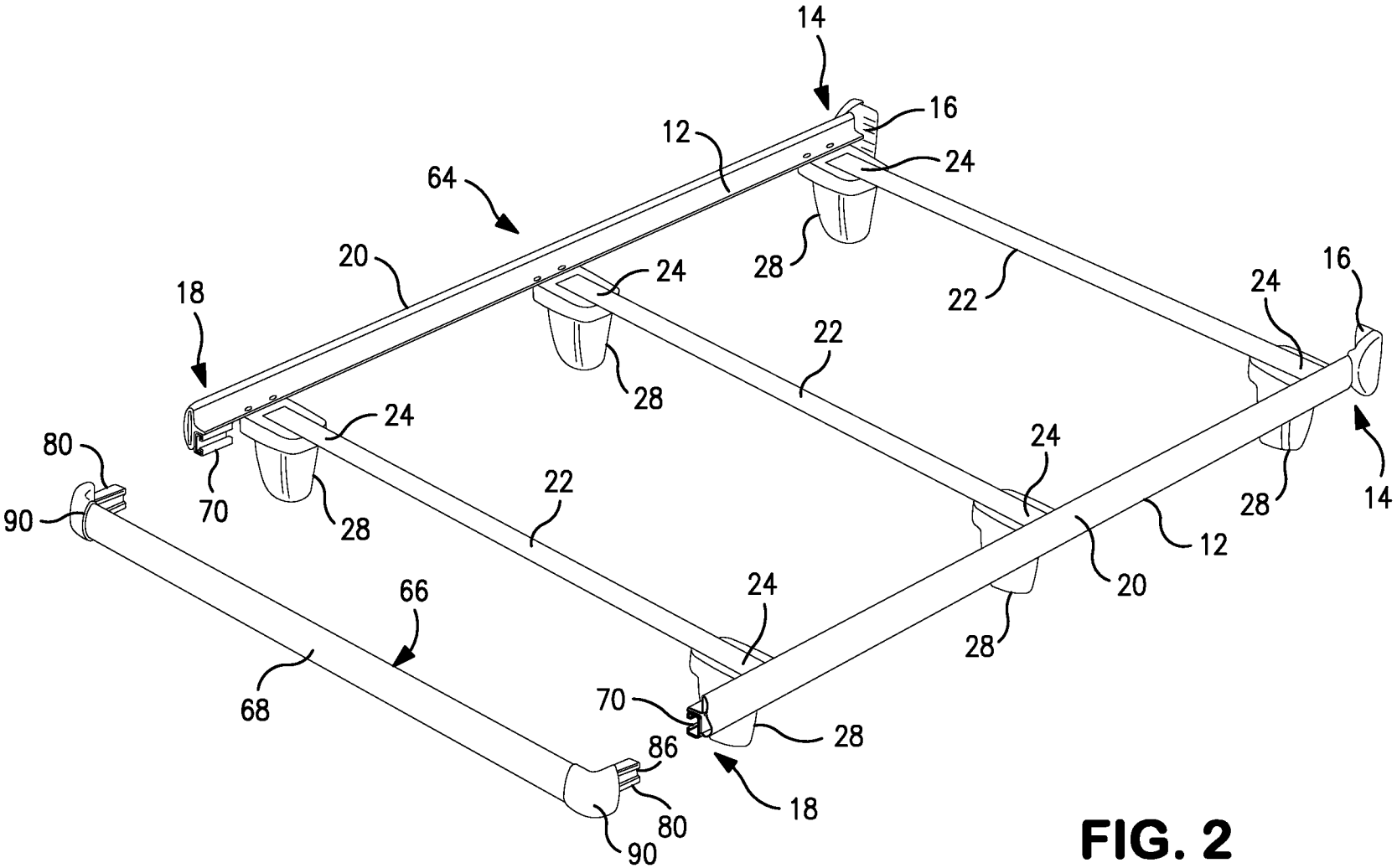
FIG. 2 is an exploded view of an alternative exemplary embodiment of the present invention.

Turning next to FIG. 2, there is shown an exploded view of a further exemplary embodiment of the present invention. Accordingly in FIG. 2, there is shown a bed frame 64 having similar components to that of the FIG. 1, 1A embodiment and where the same identification numbers will be used on corresponding elements.

Thus, the bed frame 64 is comprised of two side rails 12 oriented parallel to each other and, again, may be made up of L-shaped angle irons, T-shaped member or other configurations. The side rails 12 have head ends 14 that can include head end brackets 16 designed to be affixed to a head board (not shown) and the opposite ends of the side rails 12 have foot ends 18. The side rails 12 can have protective shields 20.

Cross members 22 are provided having opposed ends 24 affixed to the side rails 12 and span the distance therebetween, At the opposed ends 24 of each of the cross members 22, a wedge 26 (FIG. 1) is formed and which interfits into a receiver 28 having a cavity 30 (FIG. 1) formed therein.

In the embodiment of FIG. 2, the foot member 66 may be comprised of a L-shaped angle iron, a T-shaped angle iron or combination of two L-shaped angle irons affixed together or other configuration. A protective shield 68 covers the foot member 66 that may be of the type shown and described in the aforementioned '027 patent of Polevoy et al. The foot member 66 is affixed to the foot ends 18 of the side rails 12 by mean of an affixation system.

Figure 2A:
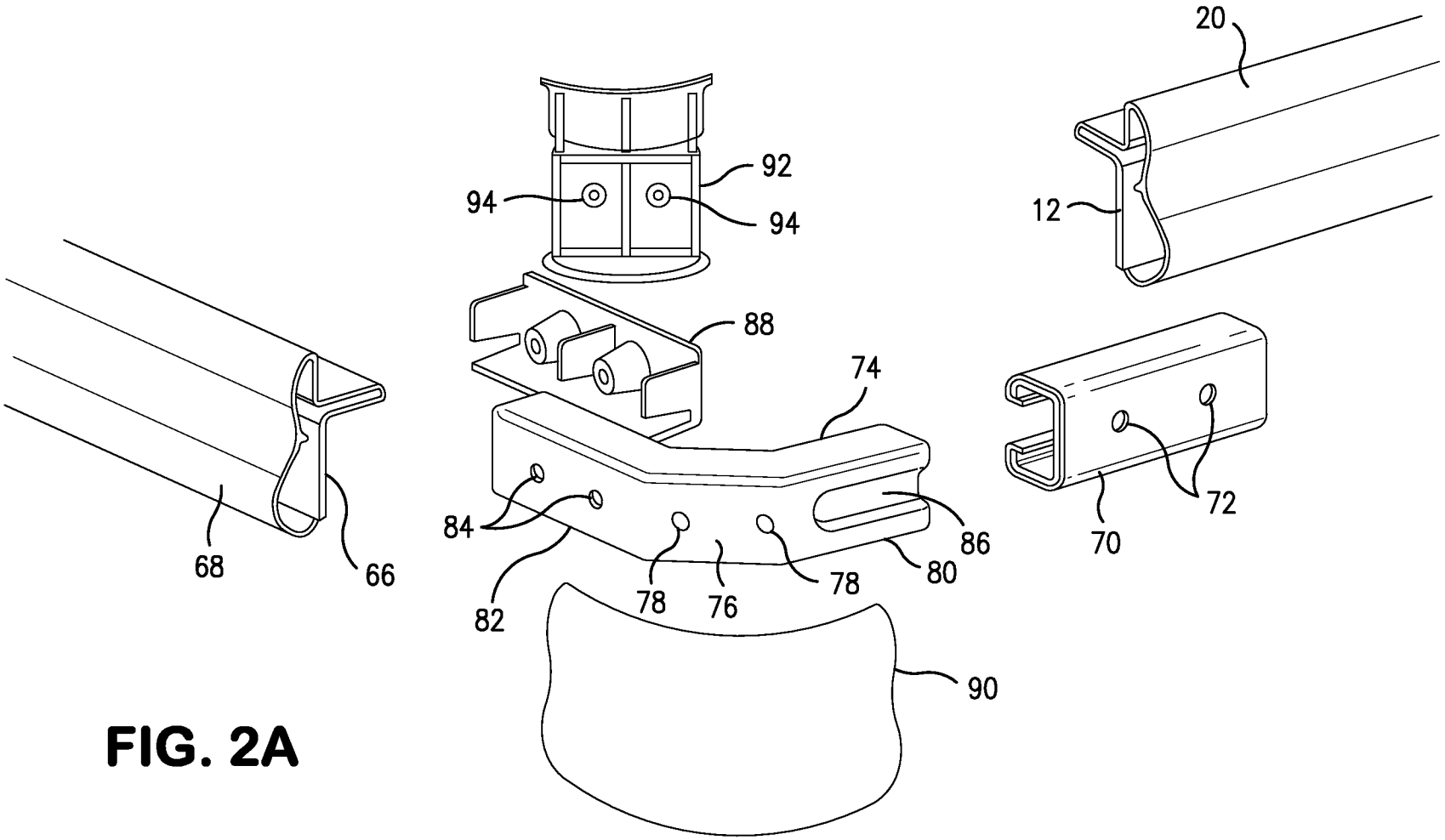
FIG. 2A is an enlarged, exploded view illustrating features of the FIG. 2 embodiment.

Turning then to FIG. 2A, taken along with FIG. 2, there is an enlarged, exploded view of the affixation system used to secure the foot member 66 to the side rails 12. In the exemplary embodiment of FIG. 2A, the foot member 66 is a T-shape having a vertical flange 67 and a horizontal flange 69 that extends outwardly from the vertical flange 67 at about the middle of the vertical flange 67. Again, as described, the T-shaped foot member 66 can be comprised of two L-shaped angle irons affixed together to form T-shape or can be a single, unitary T-shape member.

As can be seen, there is a C-shaped channel 70 having a pair of holes 72 and the C-shaped channel 70 is assembled by rivets (not shown) that secure the C-shaped channel 70 firmly to the inside surface of the side rail 12.

As with the FIG. 1, 1A embodiment, there is a bracket 74 that provides a junction between the foot member 66 and the side rail 12. The bracket 74 is comprised of three sections; a middle section 76 having one or more holes 78, a side rail section 80 that is angled with respect to the middle section 76 and a foot member section 82 that is also angled with respect to the middle section 76. In an exemplary embodiment, the side rail section 80 and foot member section 82 both extend outwardly from the middle section 76 at about a 45 degree angle, however, other angles could be utilized, with the summation of the angles adding up to 90 degrees.

In the embodiment of FIGS. 2, 2A, the foot member section 82 of bracket 74 is affixed to the foot member 66 by means of rivets, not shown, that pass through holes 84 to firmly secure the bracket 74 to the foot member 66. The side rail section 80 has an indented area 86 to facilitate the side rail section 80 being slid into the C-shaped channel 70 in a wedge connection, that is, the side rail section 80 may be tapered inwardly in the direction toward its outer end so that the side rail section 80 can be firmly wedged into the C-shaped channel 70 to secure the foot member 66 to the side rail 12.

As such, to make the connection between the foot member 66 and the side rail 12, the side rail section 80 is slid into the C-shaped channel 70 and becomes wedged therein as the side rail section 80 reaches it ultimate position to hold foot member 66 firmly to the side rail 12 in a manner that the foot member 66 provides support to the box spring and mattress later supported by the bed frame 64.

There is a molded cover 88 that can optionally be secured to the foot member section 82 of the bracket 74 to protect the foot member section 82 of the bracket 74, again, for protection against injury to the bedclothes tearing on the bracket 74 as well as for appearance sake.

A curved protective shield 90 covers the external surface of the bracket 74 so as to, again, protect the user against inadvertent injury from striking the exterior of the bracket 74 as well as provide a good appearance of the overall wrap around bed frame 64. As can be seen in FIG. 2, the curved protective shield 90 may be pre-attached to the foot member 66 such that the curved protective shield 90 slips over and overlaps the protective shield 20 that covers the side rail 12 to form a relatively seamless junction.

There can also be an internal curved protective shield 92 that covers and protects the internal surface of the bracket 74 and both of the shields 90, 92 may be affixed to the bracket 74 by means of a snap fit or make use of the holes 78 so that the curved protective shield 90 can be affixed by screws that enter into and interfit with one or more bosses 94 formed on the internal curved protective shield 92. A further feature is that the bracket 74 is symmetrical so that the same formed bracket can be used with both of the side rails 12 in assembling the bed frame 64.

As can now be seen, the assembly of the bed frame 64 of the FIG. 2, 2A embodiment is readily accomplished since all of the components drop in or snap in without the need for special tools or the like. The foot member 66 is initially installed by the slide in action and thereafter, once the foot member 66 has been installed, the cross members 22 are simply dropped in such that the wedges fit into the receivers 28 to complete the installation of the cross members 22 and finalize the assembly of the bed frame 64.

Figure 3:
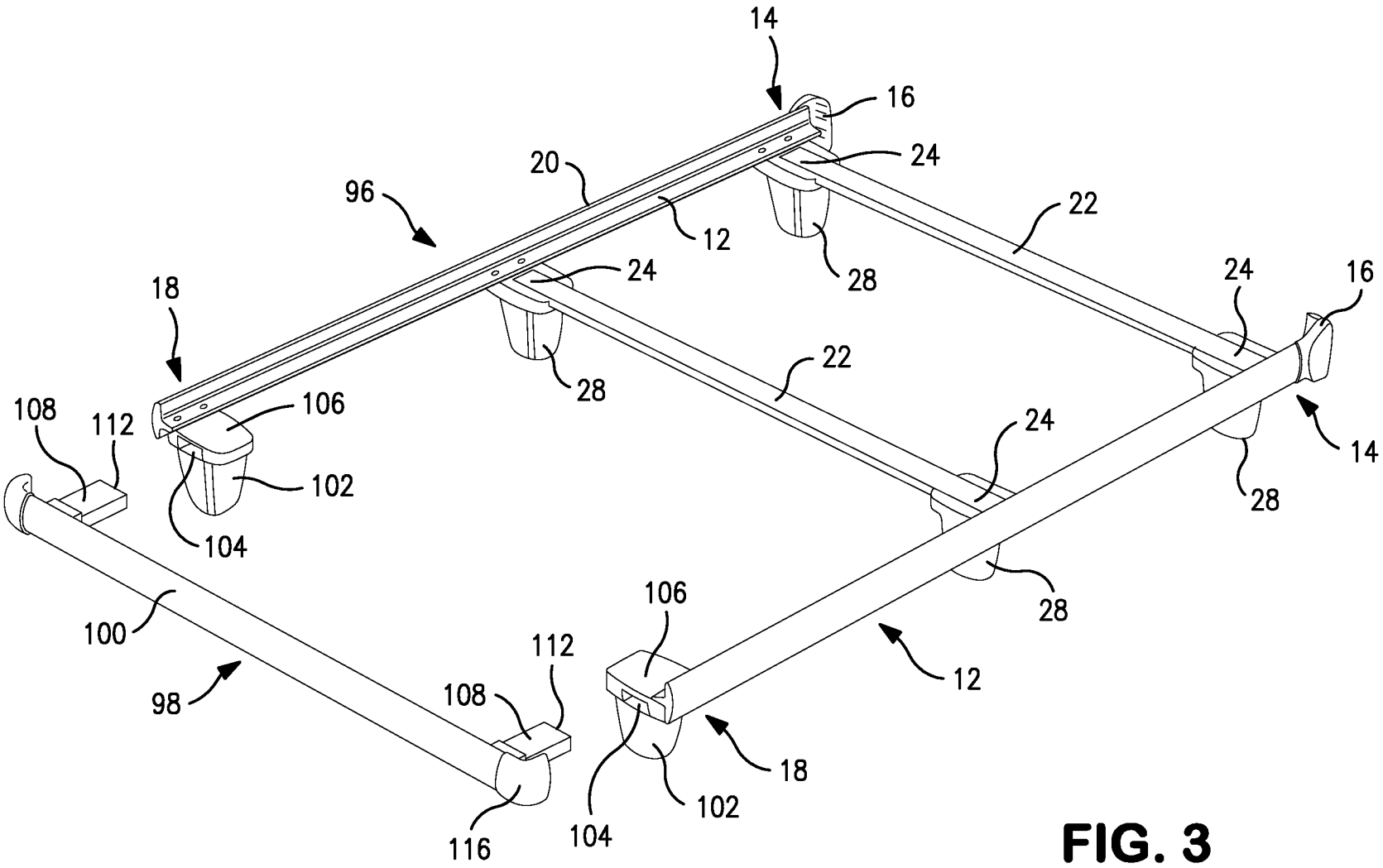
FIG. 3 is an exploded view of an alternative exemplary embodiment of the present invention.

Turning then to FIG. 3, there is shown, an exploded view of another exemplary embodiment of the bed frame 96 of the present invention and wherein, again certain of the elements are the same as shown and described with respect to the FIG. 1 and the same identification numbers have been used for corresponding elements.

Thus, the bed frame 96 is comprised of two side rails 12 oriented parallel to each other and, again, may be made up of L-shaped angle irons, T-shaped member or other configurations. The side rails 12 have head ends 14 that can include head end brackets 16 designed to be affixed to a head board (not shown) and the opposite ends of the side rails 12 have foot ends 18. The side rails 12 can have protective shields 20.

Cross members 22 are provided having opposed ends 24 affixed to the side rails 12 and span the distance therebetween, At the opposed ends 24 of each of the cross members 22, a wedge 26 (FIG. 1) is formed and which interfits into a receiver 28 having a cavity 30 (FIG. 1) formed therein.

In the embodiment of FIG. 3, the foot member 98 may be comprised of a T-shaped member made up of two angle irons affixed together, however, the foot member 98 may be an L-shaped angle iron, a unitary T-shaped steel member or other configuration and has a protective shield 100 covering the foot member 98 that may be of type shown and described in the aforementioned '027 patent of Polevoy. The foot member 98 is shown as being affixed to the foot ends 18 of the side rails 12 by means of an affixation system.

Figure 3A:
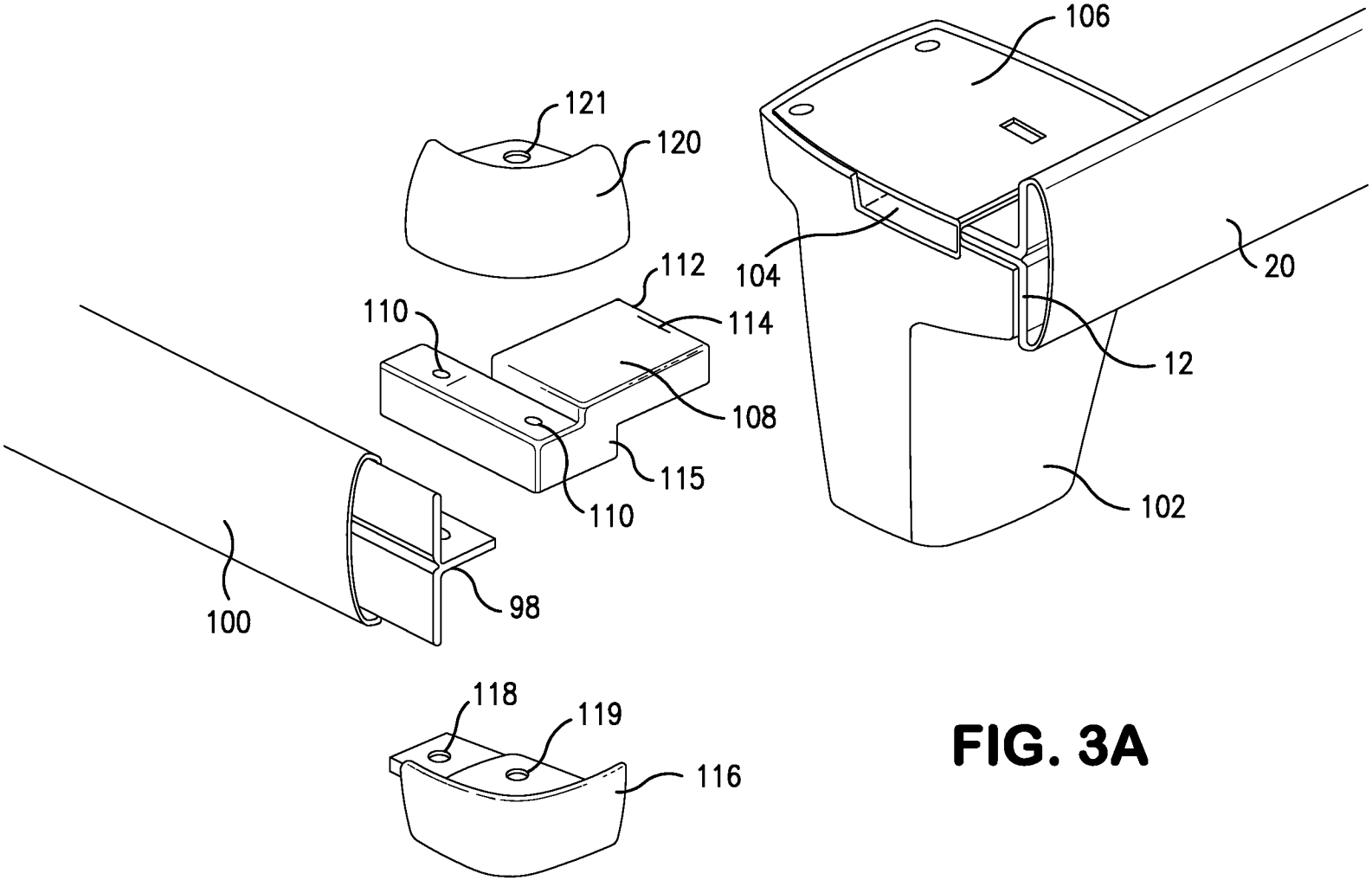
FIG. 3A is an enlarged, exploded view illustrating features of the FIG. 3 embodiment.

Thus, turning then to FIG. 3A, taken along with FIG. 3, there is an enlarged, exploded view of the affixation system used to secure the foot member 98 to a side rail 12. As can be seen, there is a receiver 102 that is located at the foot ends 18 of the side rails 12. The receiver 102 has a slot 104 formed therein and, in the embodiment of FIG. 3, the slot 104 is elongated horizontally and generally rectangular in shape. As will be seen, the configuration, size and orientation of the slot 104 may vary and still be within the scope of the present invention. The receiver 102 includes a cover 106 that closes off the internal space of the receiver 102.

There is a molded plug 108 that may be comprised of plastic and which has holes 110 formed therein for use in attaching the molded plug 108 to the foot member 98 by means such as rivets. The molded plug 108 has a distal end 112 that extends outwardly from the foot member 98.

As such, to make the connection between the foot member 98 and the side rail 12, the distal end 112 of the molded plug 108 is slid into the slot 104 and becomes affixed therein by means of some wedging action or the interfitting of a raised portion 114 that enters into and fits within a corresponding indented area (not shown) formed on the interior of the cover 106. When the molded plug 108 reaches its fully inserted position, a lower edge 115 abuts against the receiver 102, thereby holding the side rail 12 firmly to the foot member 98 in a manner that the foot member 98 provides support to the box spring and mattress later supported by the bed frame 96.

A lower curved protective shield 116 and an upper curved protective shield 120 cover the external surface of the molded plug 108 for protection to the bed coverings from damage as well as to make a good appearance for the affixation of the foot member 98 to the side rail 12. As can be seen in FIG. 3, the lower and upper curved protective shields 116, 120 may be pre-attached to the foot member 98 such that they simply slip over and overlap the protective shield 20 that covers the side rail 12 to form a relatively seamless junction.

The lower curved protective shield 116 can be affixed to the foot member 98 by means such as a rivet passing through a hole 118 in the lower curved protective shield 116 or may be secured by other mean such as a snap fit, screws or other method. A further centralized hole 119 is formed in the lower curved protective shield 116.

The upper curved protective shield 120 has a hole 121 formed therein and is positioned atop of the lower curved protective shield 116 and both of the shields 116, 120 may be affixed together by means such as one or more screws, bolts or rivets passing through holes 119 and 121 that are oriented internal of the molded plug 108 or by means of a snap-fit connection.

As can now be seen, the assembly of the bed frame 96 of the FIG. 3, 3A embodiment, is readily accomplished since all of the components drop in or slide in without the need for special tools or the like. In the assembly of the bed frame 96, the cross members 22 are initially dropped into place into the receivers 28 and, once the cross members 22 have been installed, the foot member 98 can be snapped into place to finalize the assembly of the bed frame 96.

Figure 4:
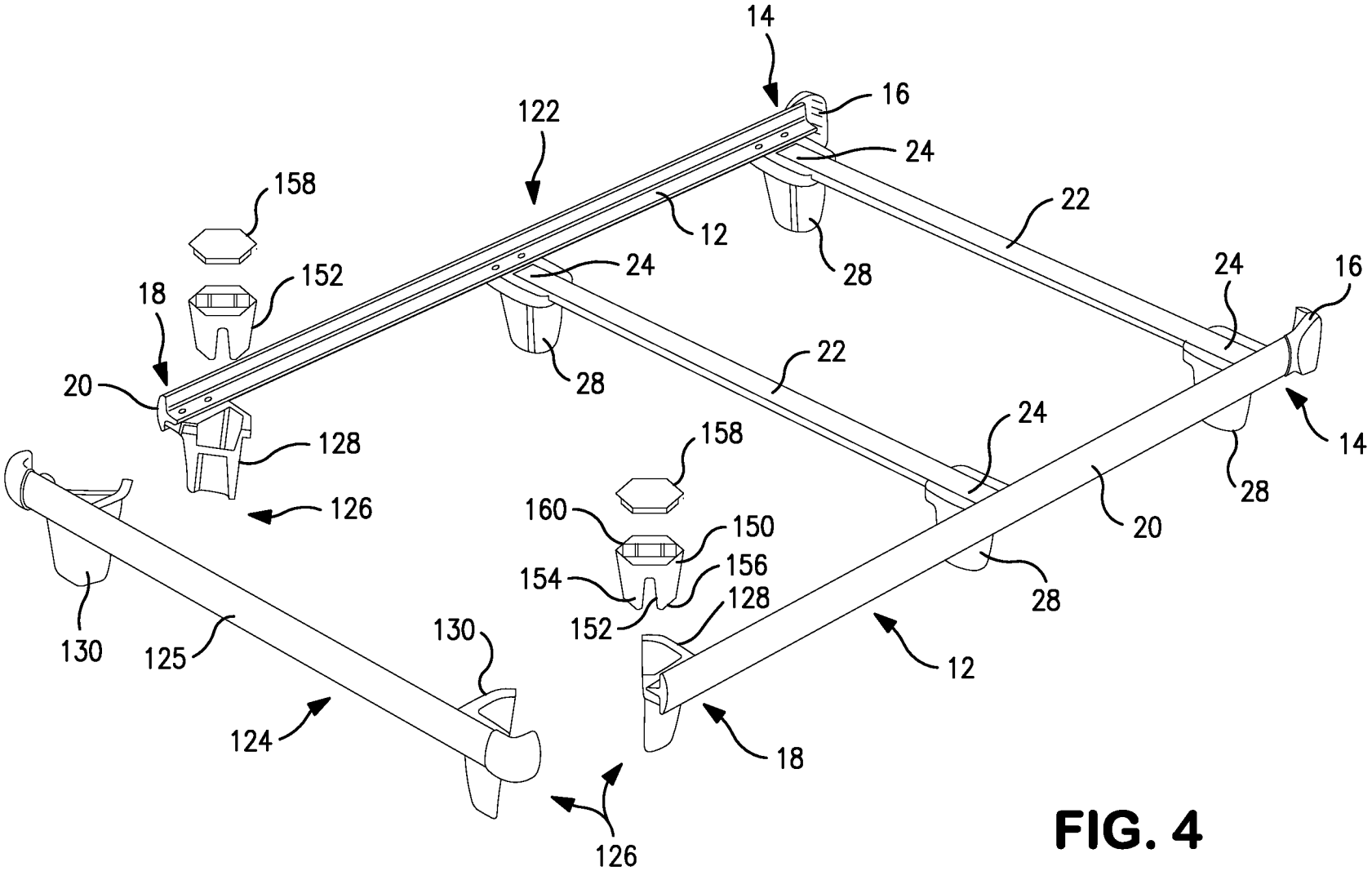
FIG. 4 is an exploded view of an alternative exemplary embodiment of the present invention.

Turning next to FIG. 4, there is shown an exploded view of another exemplary embodiment of a bed frame 122 of the present invention wherein, again, certain of the elements are the same as shown and described with respect to FIG. 1 and the same identification numbers have been used for corresponding elements.

Thus, the bed frame 122 is comprised of two side rails 12 oriented parallel to each other and, again, may be made up of L-shaped angle irons, T-shaped member or other configurations. The side rails 12 have head ends 14 that can include head end brackets 16 designed to be affixed to a head board (not shown) and the opposite ends of the side rails 12 have foot ends 18. The side rails 12 can have protective shields 20.

Cross members 22 are provided having opposed ends 24 affixed to the side rails 12 and span the distance therebetween. At the opposed ends 24 of each of the cross members 22, a wedge 26 (FIG. 1) is formed and which interfits into a receiver 28 having a cavity 30 (FIG. 1) formed therein.

In the embodiment of FIG. 4, the foot member 124 may be comprised of a T-shaped member made up of two L-shaped angle irons affixed together, however, the foot member 124 may be an L-shaped angle iron, a unitary T-shaped steel member, or other configuration and has a protective shield 125 covering the foot member 124 that may be of the type shown and described in the aforementioned '027 patent of Polevoy et al. The foot member 124 is shown as being affixed to the foot ends 18 of the side rails 12 by means of an affixation system.

Figure 4B:
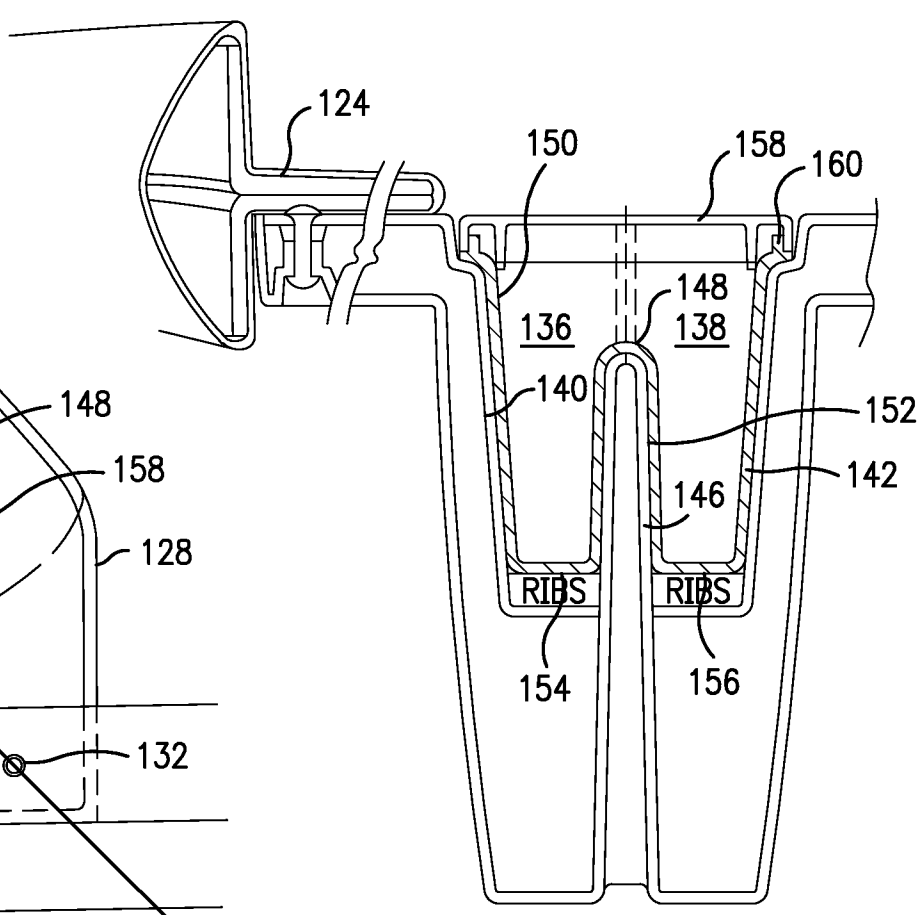
FIG. 4B is a cross sectional view of the FIG. 4 embodiment taken along the line A-A of FIG. 4A.
Figure 4A:
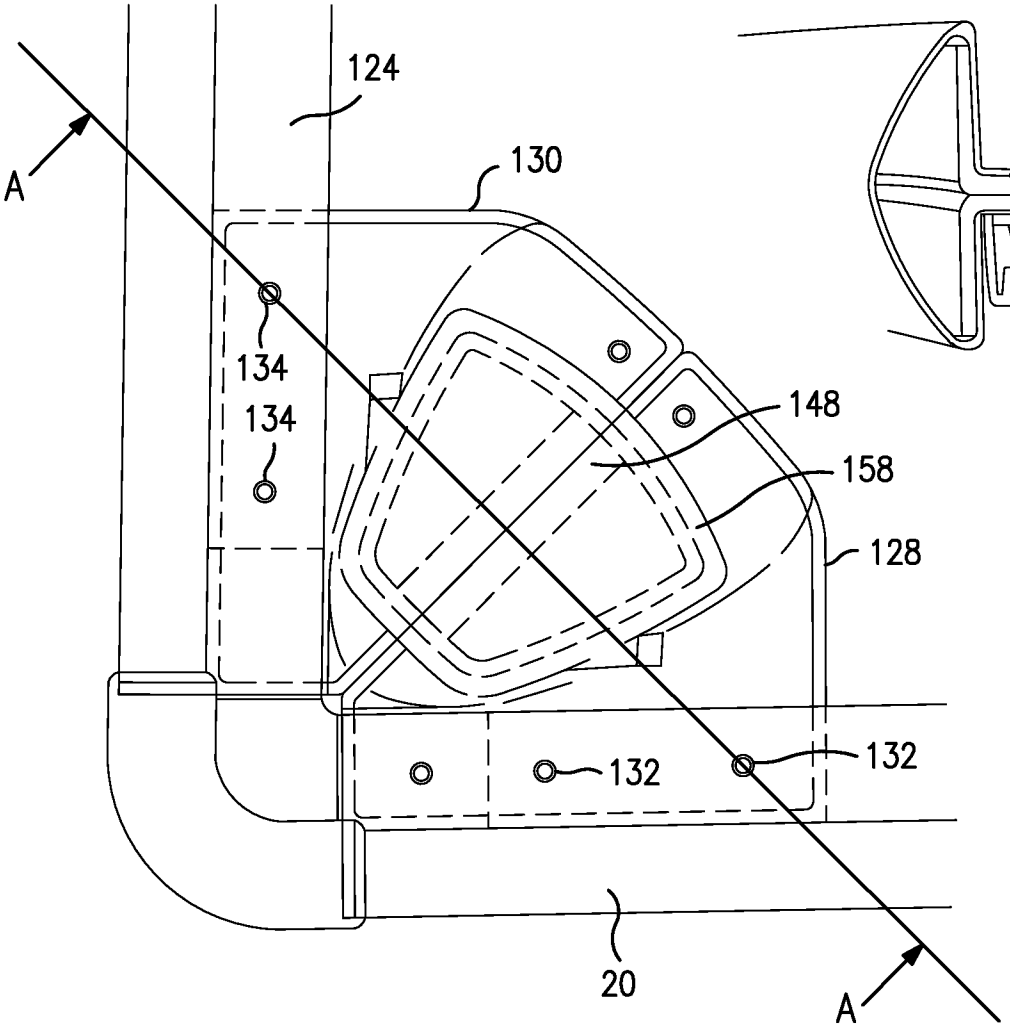
FIG. 4A is an enlarged, exploded view illustrating features of the FIG. 4 embodiment.

Thus, turning then to FIGS. 4A and 4B, taken along with FIG. 4, there is an enlarged, horizontal view and a cross sectional view taken along the line A-A of FIG. 4A, of the affixation system used to secure the foot member 124 to side rail 12. As can be seen, there is a split receiver 126 that is made up of a side rail receiver 128 and a foot member receiver 130. The split receiver 126 is basically similar to one of the other receivers 28 but the split receiver 126 has been split in half generally along a 45 degree angle to form the side rail receiver 128 and the foot member receiver 130.

The side rail receiver 128 is affixed to the side rail 12 by means such as rivets 132 and the foot member receiver 130 is affixed to the foot member 124 by means of rivets 134. As can be seen, specifically in FIG. 4A, the side rail receiver 128 and foot member receiver 130 both have cavities 136, 138, formed therein by means of rear walls 140, 142 and front walls 144 and 146, respectively.

Accordingly, when the foot member 124 is moved into its operative position abutting against the foot ends 18 of the side rail 12, the front wall 146 of side rail receiver 128 abuts against the front wall 144 of the foot member receiver 130, forming an upstanding barrier 148 between the side wall receiver 128 and the foot member receiver 130.

In the position with the side rail receiver 128 and foot member receiver 130 abutting each other, a plastic wedge 150 is inserted downwardly into both of the cavities 136, 138 of the side rail receiver 128 and the foot member receiver 130. The plastic wedge 150 has a groove 152 formed therein to create two downwardly extending members 154, 156. As such, when the plastic wedge 150 is inserted, the groove 152 straddles the upstanding barrier 148 and the downwardly extending members 154, 156 enter into the cavities 136, 138, respectively, to hold the side rail receiver 128 and foot member receiver 130 firmly together to affix the foot member 124 to the side rail 12.

With the completion of that insertion, a cover 158 can be snap fitted to the upper peripheral edge 160 of the plastic wedge 150. Alternatively, the cover 158 can be preassembled to the foot member 124 or the side rails 12.

Figure 5:
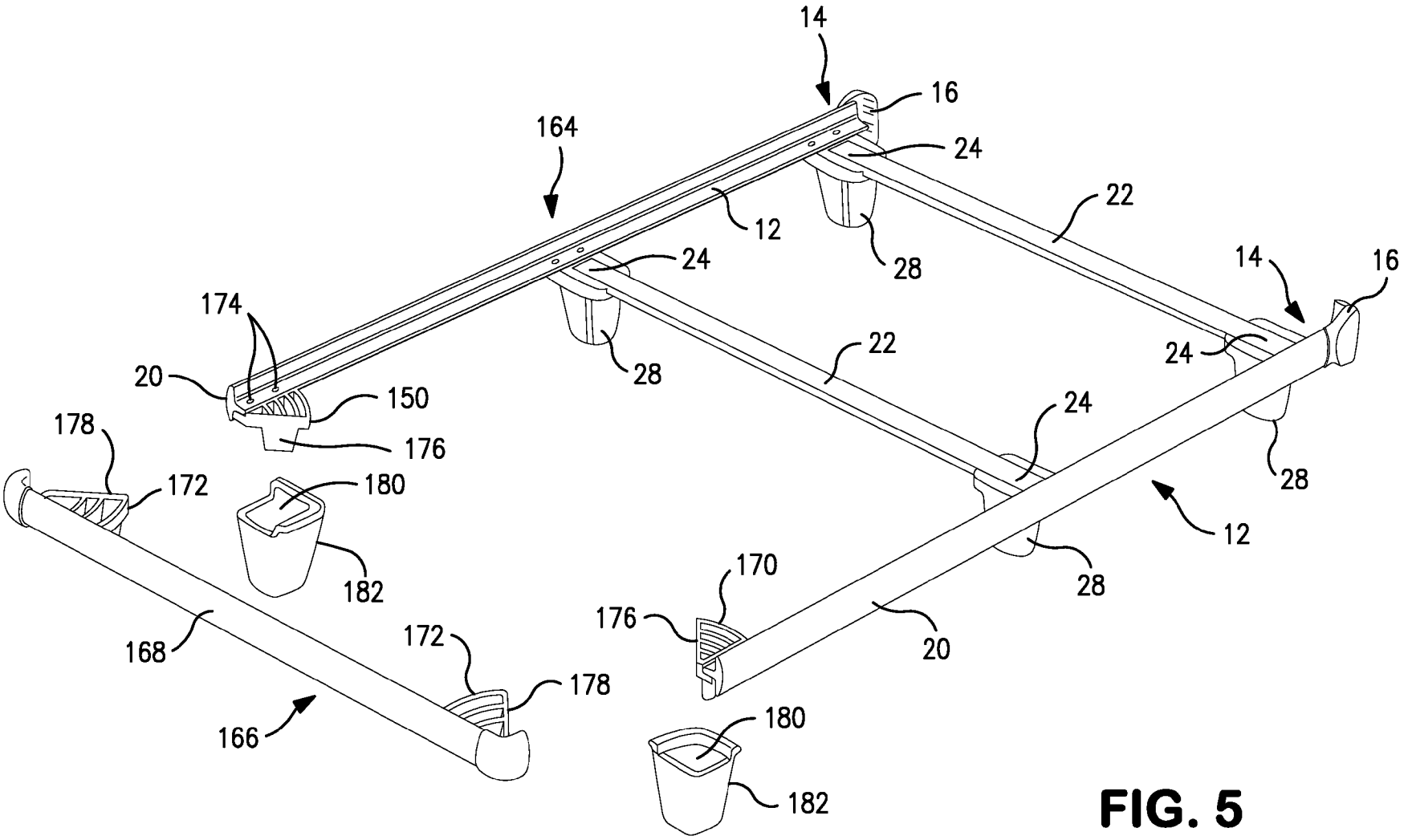
FIG. 5 is an exploded view of an alternative exemplary embodiment of the present invention.

Turning next to FIG. 5, there is shown an exploded view of an exemplary embodiment of a bed frame 164 constructed in accordance with the present invention. Again, certain of the elements are the same as shown and described with respect to FIG. 1 and the same identification numbers have been use for corresponding elements.

Thus, the bed frame 164 is comprised of two side rails 12 oriented parallel to each other and, again, may be made up of L-shaped angle irons, T-shaped member or other configurations. The side rails 12 have head ends 14 that can include head end brackets 16 designed to be affixed to a head board (not shown) and the opposite ends of the side rails 12 have foot ends 18. The side rails 12 can have protective shields 20.

Cross members 22 are provided having opposed ends 24 affixed to the side rails 12 and span the distance therebetween, At the opposed ends 24 of each of the cross members 22, a wedge 26 (FIG. 1) is formed and which interfits into a receiver 28 (FIG. 1) having a cavity 30 formed therein.

In the embodiment of FIG. 5, the foot member 166 may be comprised of a T-shaped member made up of two L-shaped angle irons affixed together, however, the foot member 166 may be an L-shaped angle iron, a unitary T-shaped steel member, or other configuration and has a protective shield 168 covering the foot member 166 that may be of the type shown and described in the aforementioned '027 patent of Polevoy et al. The foot member 166 is shown as being affixed to the foot ends 18 of the side rails 12 by means of an affixation system.

The affixation system in embodiment of FIG. 5 includes a pair of quarter pie shaped wedges located on the side rails 12 and the foot member 166, that is, there are pie shaped side rail wedges 170 and foot member wedges 172 that are affixed, respectively, to the side rails 12 and the foot member 166 and that affixation may be carried out by the use of rivets 174 (only two of which can be seen in FIG. 5, however, it will be seen that the rivets can be used to secure all of the side rail wedges 170 and foot member wedges 172 to the side rails 12 and foot member 166, respectively).

The side rail wedges 170 have an outer surface 176 that is formed at about a 45 degree angle with respect to the side rail 12 and, in a similar fashion, the foot member wedges 172 have an outer surface 178 that is formed at about a 45 degree angle with respect to the foot member 166. Other angular relationships can be used providing, however, the summation of the angles totals 90 degrees.

As can then be seen, when the foot member 166 is moved into its assembled position in constructing the bed frame 164, the outer surface 176 of the side rail wedges 170 and the outer surface 178 of the foot member wedges 172 will abut against each other along a plane. At this point, the completed, now half pie shape combination of the side rail wedges 170 and foot member wedges 172 can be dropped into the cavity 180 of a bucket 182. The shape and configuration of the cavity 180 is, of course, designed to tightly surround the combined side rail wedges 170 and foot member wedges 172 and may provide a slight tapering to hold those side rail wedges 170 and foot member wedges 172 tightly against each other within the cavity 180.

As such, the foot member 166 is securely affixed to the side rail 12 in a manner such that the foot end of a box spring and mattress are fully supported by the bed frame 164.

Figure 6:
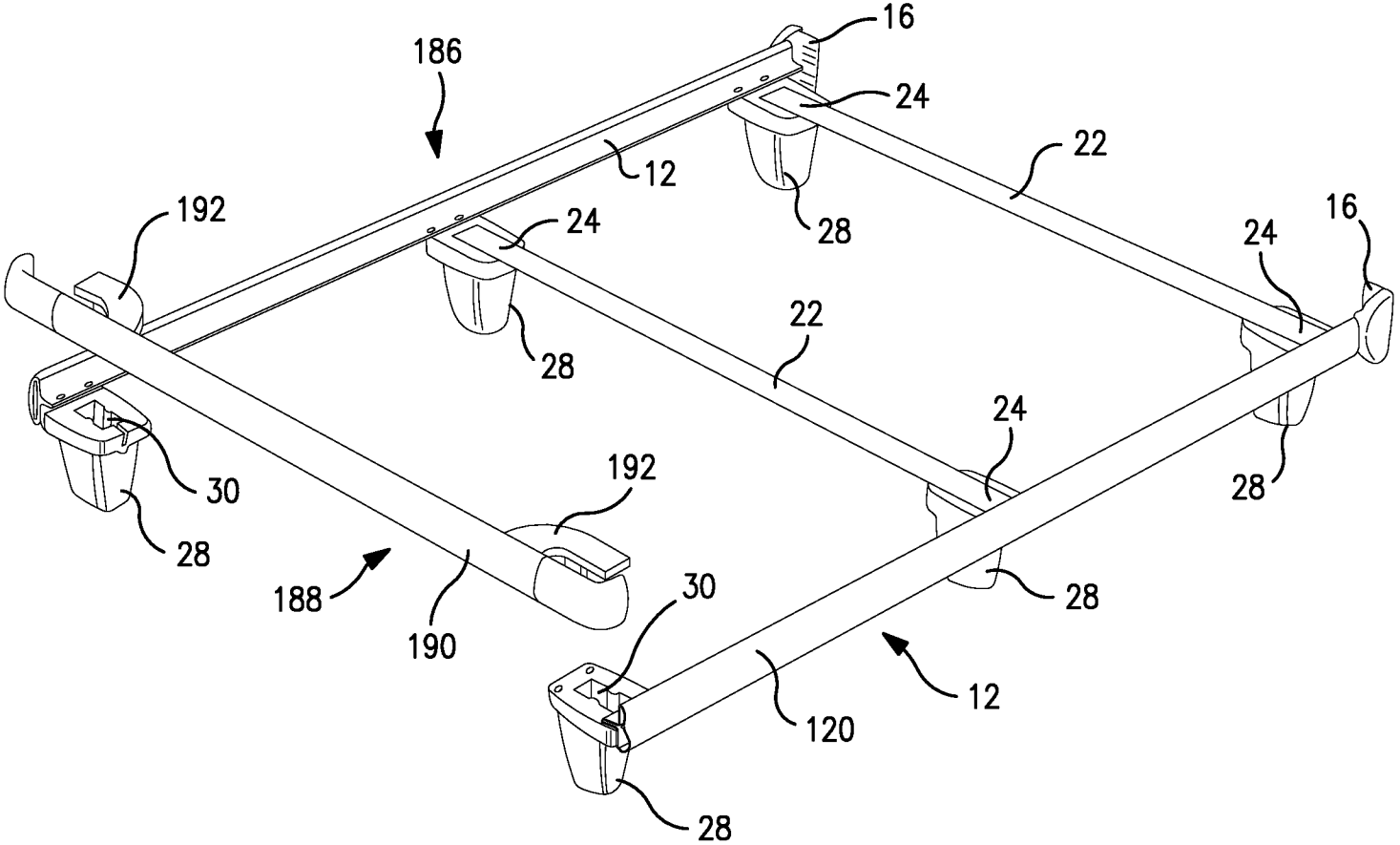
FIG. 6 is an exploded view of an alternative exemplary embodiment of the present invention.

Turning next to FIG. 6, there is shown an exploded view of an exemplary embodiment of a bed frame 186 constructed in accordance with the present invention. Again, certain of the elements are the same as shown and described with respect to FIG. 1 and the same identification numbers have been use for corresponding elements.

Thus, the bed frame 186 is comprised of two side rails 12 oriented parallel to each other and, again, may be made up of L-shaped angle irons, T-shaped member or other configurations. The side rails 12 have head ends 14 that can include head end brackets 16 designed to be affixed to a head board (not shown) and the opposite ends of the side rails 12 have foot ends 18. The side rails 12 can have protective shields 20.

Cross members 22 are provided having opposed ends 24 affixed to the side rails 12 and span the distance therebetween, At the opposed ends 24 of each of the cross members 22, a wedge 26 (FIG. 1) is formed and which interfits into a receiver 28 having a cavity 30 formed therein.

In the embodiment of FIG. 6, the foot member 188 may be comprised of a T-shaped member made up of two L-shaped angle irons affixed together, an L-shaped angle iron, a unitary T-shaped steel member, or other configuration and has a protective shield 190 covering the foot member 188 that may be of the type shown and described in the aforementioned '027 patent of Polevoy et al. The foot member 188 is shown as being affixed to the foot ends 18 of the side rails 12 by means of an affixation system.

Figure 6A:
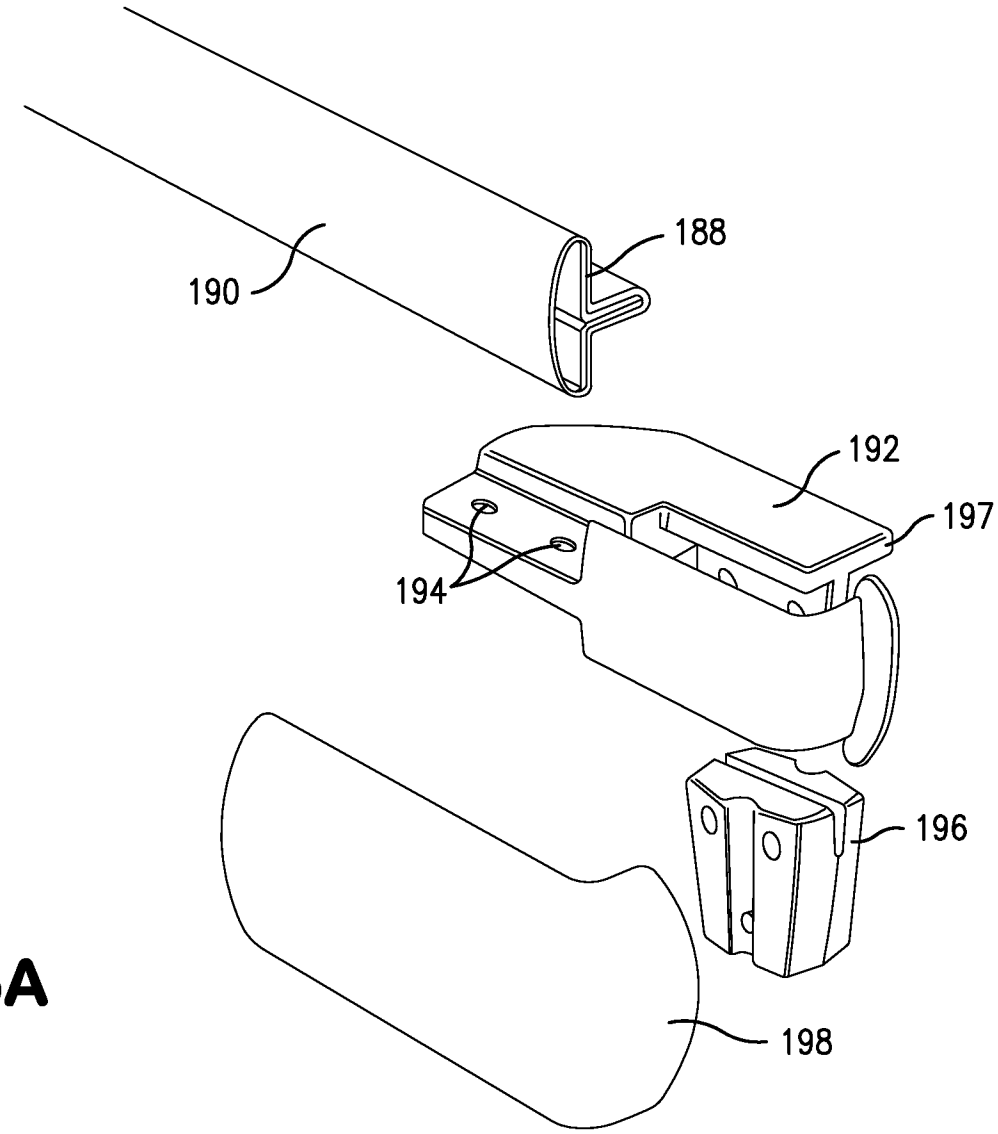
FIG. 6A is an enlarged exploded view illustrating features of the FIG. 6 embodiment

Turning to FIG. 6A, taken along with FIG. 6, there is shown an enlarged exploded view illustrating the affixation system used to secure the foot member 188 to the side rails 12 and the system includes a pair of brackets 192 that are affixed to the foot member 188. Brackets 192 may be secured to the foot member 188 by the use of rivets (not shown) that pass through holes 194 in the brackets 192. Each bracket 192 includes a downwardly extending wedge 196 that is dimensioned and shaped to fit within a cavity 30 formed in a receiver 28.

The downwardly extending wedges 196 may be formed integral with the brackets 192 of molded separately and affixed to an upper bracket 197 by means such as rivets. The receiver 28 and cavity 30 can have the same dimensions and shape used to secure the cross members 22 to the side rails 12 so that all of the receivers 28 are uniform or may have a different configuration.

Finally, as with the prior embodiments, there is a curved protective shield 198 that is affixed to the foot member 188 to overlay, cover and protect the junction between the foot member 188 and the side rail 12 by means of a snap fit or may be screwed onto those components and which overlaps the protective shield 20 of the side rail 12 to provide a good appearance of a seamless connection.

Figure 7:
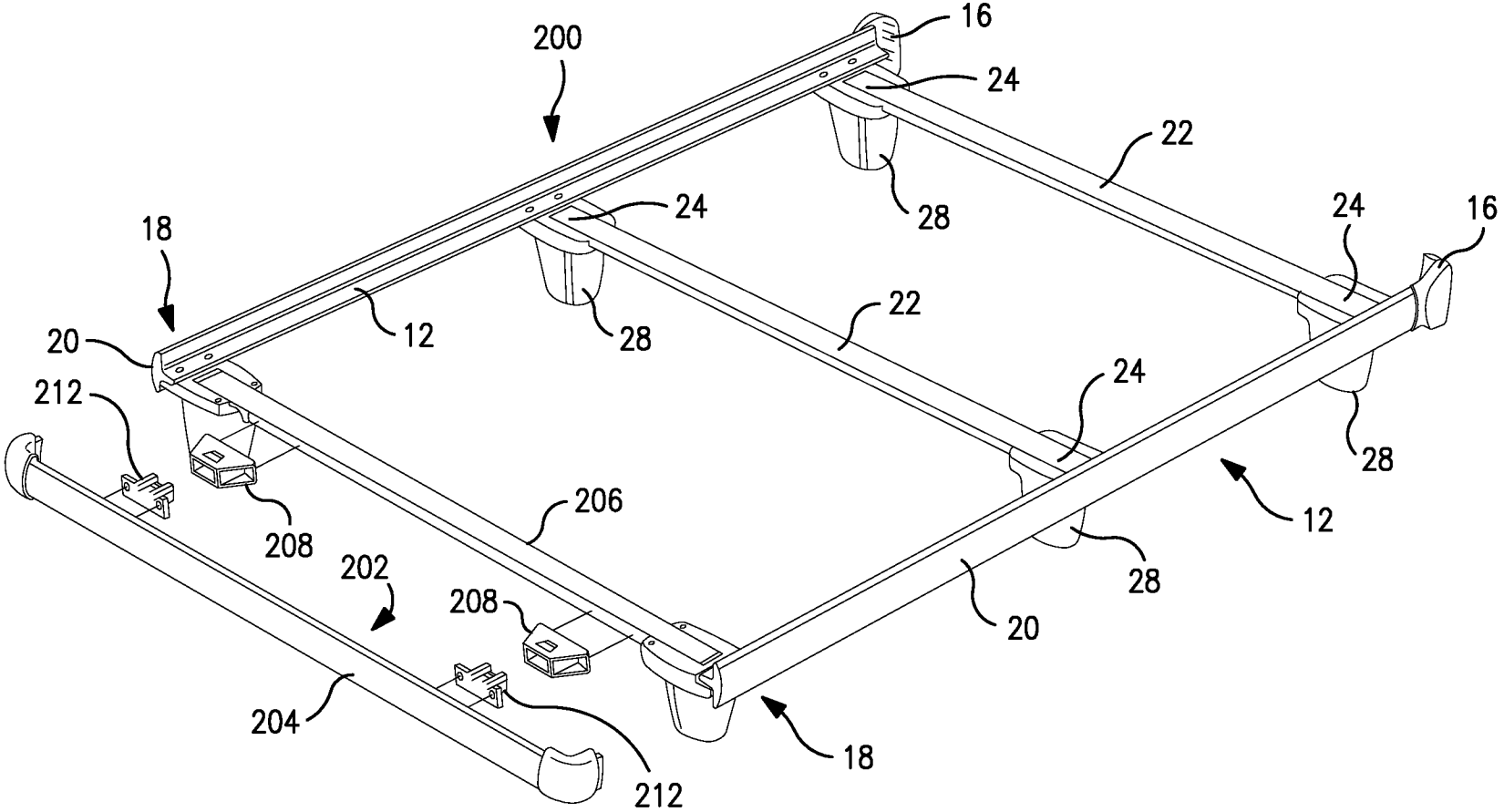
FIG. 7 is an exploded view of an alternative exemplary embodiment of the present invention.

Turning next to FIG. 7, there is shown an exploded view of an exemplary embodiment of a bed frame 200 constructed in accordance with the present invention. Again, certain of the elements are the same as shown and described with respect to FIG. 1 and the same identification numbers have been use for corresponding elements.

Thus, the bed frame 200 is comprised of two side rails 12 oriented parallel to each other and, again, may be made up of L-shaped angle irons, T-shaped member or other configurations. The side rails 12 have head ends 14 that can include head end brackets 16 designed to be affixed to a head board (not shown) and the opposite ends of the side rails 12 have foot ends 18. The side rails 12 can have protective shields 20.

Cross members 22 are provided having opposed ends 24 affixed to the side rails 12 and span the distance therebetween, At the opposed ends 24 of each of the cross members 22, a wedge 26 (FIG. 1) is formed and which interfits into a receiver 28 (FIG. 1) having a cavity 30 formed therein.

In the embodiment of FIG. 7, the foot member 202 has a protective shield 204 covering the foot member 202 that may be of the type shown and described in the aforementioned '027 patent of Polevoy et al. The foot member 202 is shown as being affixed to the foot ends 18 of the side rails 12 by means of an affixation system.

With this embodiment, there is a cross member 206 located at the foot ends 18 of the side rails 12 and the cross member 206 may be the same as the cross members 22 in different locations along the side rails 12. Affixed to the cross member 206 is a female snap fitting 208 of conventional design and which may be affixed to the cross member 206 by rivets, screws or other securing device to firmly secure the female snap fitting 208 to the cross member 206.

The foot member 202 is adapted to be affixed to the foot ends 18 of the side rails 12 and a male snap fitting 212 is likewise affixed to the vertical surface of the foot member 202 by means such as rivets, screws or similar securing device.

Accordingly, to assemble the bed frame 200, the male snap fittings 214 are aligned with the female snap fittings 208 and one inserted into the other in a snap fit to securely affix the foot member 202 to the side rails 12. With this embodiment, it is obvious that the female and male snap fittings 208, 212 may be reversed and that other conventional snap fittings can be used that are commercially available for various purposes. The feature is that the foot member 202 can be easily assembled to the side rail 12 by simply a snap-in action to facilitate the assembly of the bed frame 200.

Figure 8:
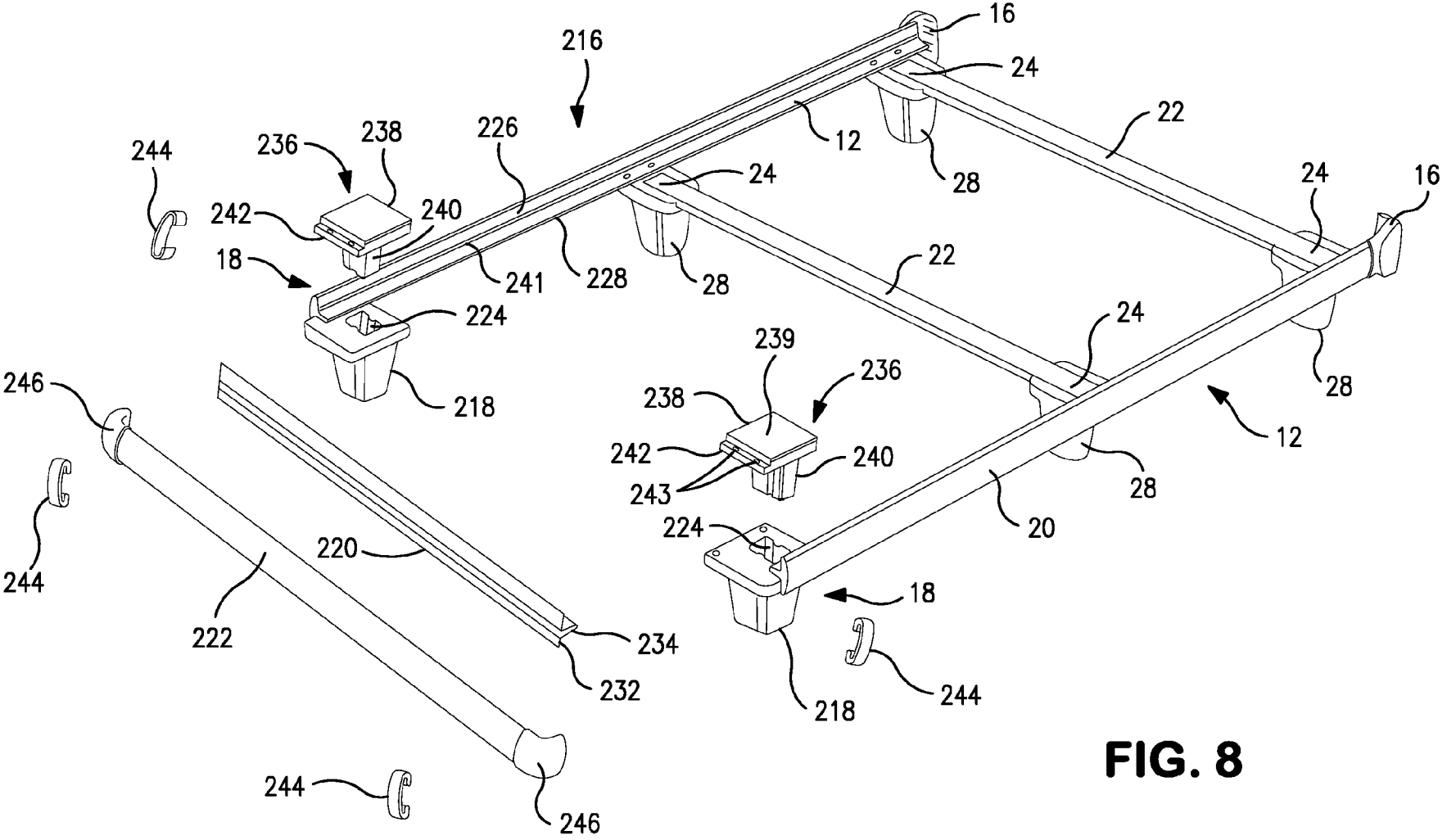
FIG. 8 is an exploded view of an alternative exemplary embodiment of the present invention.

Finally, turning to FIG. 8, there is shown a further exemplary embodiment of the present invention wherein the bed frame 216 has cross members 22 that interfit into receivers 28. At the foot ends 18 of the side rails 12, the receivers 218 can be constructed the same as the receivers 28 for uniformity. Again, there is a foot member 220 having a protective shield 222 affixed thereto as in the prior embodiments.

As such, the receivers 218 can be side specific, that is, the same receiver 218 used for one side rail 12 cannot be used for the other side rail 12. The receivers 218 have cavities 224 formed therein and which are shaped and dimensioned, preferable, to accept one of the same dimensioned wedges used with the cross members 22.

In this embodiment, the side rails 12 are T-shaped members that have a vertical flange 226 and an inwardly directed horizontal flange 228 located at about the center of the vertical flange 226 with the foot member 220 also comprising a T-shaped member having a vertical flange 232 and a horizontal flange 234 extending inwardly therefrom located at about the center of the vertical flange 232.

Wedges 236 are provided that comprise an upper flange 238 and a downwardly extending wedge member 240 that may be affixed to the upper flange 238 by means such as rivets, screws or other affixing devices. Alternatively, a wedge 236 may be molded of a single material. In any event, the upper flange 238 has lowered ridge 242 having holes 243 formed therein for rivets (not shown) to affix the upper flange 238 to the lower surface of the horizontal flange 234 of the foot member 220. By use of the lowered ridge 242, when the upper flange 238 is affixed to the bottom surface of the horizontal flange 234 of foot member 220, the top surface 239 of the upper flange 238 is flush with the upper surface 241 of the horizontal flange 228 of the side rails 12.

As such, when the foot member 220 is assembled to the side rails 12, by dropping the wedges 236 into the cavities 224, the upper surface 239 of the upper flange 238 is basically flush with the upper surface of the horizontal flange 228 of the side rails 12 and thus forms a uniform, flat surface for supporting the box spring and mattress thereon.

With the drop-in assembly of the FIG. 8 embodiment, due to the tolerances of the various components, there is the possibility that a gap is created between the junction of the foot member 220 and the side rails 12. Accordingly, to retain the esthetic and visually pleasing appearance of the overall bed frame 216, there may also be a one or more clips 244 the can be easily snapped on to the junction between the side rails 12 and the foot member 220 to cover those gaps.

As can be seen in FIG. 8, there are four clips 244 that can be used to cover gaps between the various protective shields, that is, between the protective shield 222 of the foot member 220 and the curved protective shields 246 and between the curved protective shields 246 and the protective shields 20 of the side rails 12.

With the clips 244, the gaps are covered and the overall smooth appearance is continued of the junction between the foot member 220 and the side rails 12.

While the present invention has been set forth in terms of a specific embodiment of embodiments, it will be understood that the present wrap around bed frame and components therefore herein disclosed may be modified or altered by those skilled in the art to other configurations. Accordingly, the invention is to be broadly construed and limited only by the scope and spirit of the claims appended hereto.

What is claimed is:

1. A bed frame assembly for supporting a mattress or mattress set, the bed frame assembly comprising side rails having foot ends and at least one cross member spanning between the side rails, a foot member affixed to the foot ends of the side rails by an affixation system to provide support for the mattress or mattress set, the foot member having a vertical flange and a horizontal flange extending outwardly from the vertical flange at about the center of the vertical flange, wherein the affixation system includes a receiver having a cavity formed therein affixed to one of the side rails, said side rail having a horizontal flange having an upwardly facing surface, and a wedge affixed to the horizontal flange of the foot member, the wedge having an upper flange having an upwardly facing surface and a downwardly extending wedge member that is dimensioned to fit into the cavity to affix the foot member to the affixed side rail, wherein the upwardly facing surface of the upper flange is in the same plane as the upwardly facing surface of the horizontal flange of the side rail, wherein the side rails each have a side rail protective shield affixed thereto and the foot member has a foot member protective shield affixed thereto, wherein curved protective shields are located between the foot member and the side rails to provide a smooth transition between the foot member protective shield and the side rail protective shields, wherein each curved protective shield is aligned with and meets at a respective junction with the foot member protective shield and each curved protective shield is aligned with and meets at a respective junction with a respective one of the side rail protective shields, wherein at least one of the junctions includes a gap between the respective protective shields, each of the at least one gaps being covered by a curved c-shaped clip snap fit at the respective gap to either the foot member or the side rail located at the respective gap, the clip having a curvature matching the curvature of adjacent protective shields so as to maintain an overall smooth appearance and the clip having a vertically defined height and having a width extending along either a longitudinal or transverse axis of the bed frame assembly, the height being greater than the width.

2. The bed frame assembly of claim 1 wherein the downwardly extending wedge member is affixed to the upper flange by means of rivets.

3. The bed frame assembly of claim 1 wherein the foot member has a T-shape lateral cross section.

4. The bed frame assembly of claim 1 wherein the upper flange has a lower ridge having a surface lower than the upwardly facing surface of the upper flange and the horizontal flange of the foot member is affixed to the lower ridge such that the upwardly facing surface of the horizontal flange of the foot member and the upwardly facing surface of the upper flange are in the same plane.

5. A bed frame assembly for supporting a mattress or mattress set, the bed frame assembly comprising side rails each having a foot end and at least one cross member spanning between the side rails, a foot member affixed to the foot ends of the side rails by an affixation system to provide support for the mattress or mattress set, wherein the affixation system includes a plurality of receivers each having a cavity, each of said receivers being affixed to one of the side rails, the side rails each having a horizontal flange with an upwardly facing surface, and the affixation system further including a plurality of wedges affixed to the foot member, the wedges each having a downwardly extending wedge member configured to fit into a respective cavity of the cavities to affix the foot member to the side rails, wherein the side rails each have a side rail protective shield affixed thereto and the foot member has a foot member protective shield affixed thereto, wherein curved protective shields are located between the foot member and the side rails to provide a smooth transition between the foot member protective shield and the side rail protective shields, wherein each curved protective shield is aligned with and meets at a respective junction with the foot member protective shield and each curved protective shield is aligned with and meets at a respective junction with a respective one of the side rail protective shields, wherein at least one of the junctions includes a gap between the respective protective shields, each of the at least one gaps being covered by a curved c-shaped clip snap fit at the respective gap to either the foot member or the side rail located at the respective gap, the clip having a curvature matching the curvature of adjacent protective shields so as to maintain an overall smooth appearance and the clip having a vertically defined height and having a width extending along either a longitudinal or transverse axis of the bed frame assembly, the height being greater than the width.

* * * * *